US007458809B2

(12) United States Patent
Hohenshelt et al.

(10) Patent No.: US 7,458,809 B2
(45) Date of Patent: Dec. 2, 2008

(54) PORTABLE KILN

(75) Inventors: John S. Hohenshelt, Heath, TX (US); Robert L. Gieselman, Dallas, TX (US); David T. Beaumont, Dallas, TX (US)

(73) Assignee: JSH Management, Inc., Heath, TX (US)

( * ) Notice: Subject to any disclaimer, the term of this patent is extended or adjusted under 35 U.S.C. 154(b) by 1019 days.

(21) Appl. No.: 10/316,356

(22) Filed: Dec. 11, 2002

(65) Prior Publication Data

US 2004/0115583 A1 Jun. 17, 2004

(51) Int. Cl.
*F27B 9/00* (2006.01)

(52) U.S. Cl. ..... 432/120; 432/237; 432/238; 432/250

(58) Field of Classification Search ..... 432/120, 432/250, 237, 238; 110/180, 182; 122/19.2; 126/25 R, 30, 275 R, 211
See application file for complete search history.

(56) References Cited

U.S. PATENT DOCUMENTS 2,867,208 A * 1/1959 True et al. ..... 126/276
3,196,252 A 7/1965 Weingrad
3,633,561 A * 1/1972 Barnett et al. ..... 126/21 R
3,752,643 A 8/1973 Robinson
3,786,162 A 1/1974 Colson
3,958,923 A 5/1976 Duncan
4,071,738 A * 1/1978 Jenn et al. ..... 219/400
4,139,340 A 2/1979 Bartel
4,215,265 A 7/1980 White
4,272,670 A 6/1981 Docx
4,536,153 A 8/1985 Anthony
4,620,373 A * 11/1986 Laskowski et al. ..... 34/406
4,628,895 A 12/1986 Santilli
4,692,593 A 9/1987 Chiu
4,705,930 A 11/1987 Sathre, Jr. et al.
4,730,564 A * 3/1988 Abboud ..... 110/246
4,848,311 A * 7/1989 Dorri ..... 126/21 R
5,020,481 A * 6/1991 Nelson ..... 122/494
5,139,255 A * 8/1992 Sollami ..... 482/58
5,378,144 A 1/1995 Cress
5,477,029 A 12/1995 Skutt et al.
5,498,852 A 3/1996 Cress
5,526,583 A * 6/1996 Hull et al. ..... 34/491
5,653,001 A * 8/1997 Lane ..... 16/340
5,734,149 A 3/1998 Skutt et al.
5,910,006 A 6/1999 Conroy et al.
6,290,490 B1 * 9/2001 Cacace ..... 431/346

* cited by examiner

*Primary Examiner*—Jiping Lu
(74) *Attorney, Agent, or Firm*—Dennis T. Griggs

(57) ABSTRACT

A portable kiln has a set of wheels, a handle and a platform base. The wheels and the handle are attached on a first side of the kiln so that the kiln can be tilted and rolled on the wheels using the handle. The platform base provides a spaced distance between the wheels and the floor when the kiln is sitting upright in an operational position. The kiln may also include a metal outer shell wrapped about an oven portion. The outer shell has a shell sidewall radially spaced from the oven portion sidewall, which forms an annular air channel between the outer shell sidewall and the oven portion. The outer shell has a C-shaped cross-section and it has upper and lower vent openings for the air channel. A hinge assembly allows a lid of the kiln to rest in an open position.

7 Claims, 5 Drawing Sheets

PORTABLE KILN

BACKGROUND OF THE INVENTION

The present invention relates to kilns. In one aspect, it relates to a small, lightweight and portable kiln that may be used by home artists and hobbyists.

Kilns are often used for firing pottery or ceramics, both commercially and by hobbyists. Kilns are also used in laboratories to provide specific heat cycles for forming materials and/or testing already-formed materials. Kilns are used by custom knife artisans for creating and/or heat treating knife blades. There are many other possible uses for kilns, including but not limited to: annealing, china painting, enameling, glass fusing, glass sagging, glass shaping, heat treating, jewelry fabrication, porcelain, silver clay, and stoneware, for example. The sizes and shapes of currently available kilns vary widely. Usually the sizes and shapes of kilns correspond to the intended use of the kiln.

Internal temperatures within a kiln may be as hot as 2300° F. during operation of the kiln. Usually, thick ceramic blocks forming walls define an oven space or enclosure, and are used to confine the heat within the kiln. However, the use of such blocks typically causes the kiln to be very heavy and difficult to move. Hence, there is a need for a more lightweight kiln that is easier to move.

With the use of conventional insulation (ceramic blocks), the outside surface of a conventional kiln may experience temperatures as hot as 400° F. However, such outside temperatures may not be safe for use within a home by hobbyists due to risks of fire or risks of human contact with the outer surface of the kiln. Hence, to have a kiln suitable for use in a home by a hobbyist, there is a need for a way to reduce the external surface temperature to increase the safety during use.

Also, many home hobbyists or small laboratories that only occasionally use a kiln may not have a suitable work space or it may not be desirable to leave a kiln in a useable position (i.e., away from the wall and away from other objects that may catch fire or melt if too close to an operating kiln) when it is not in use. For example, a hobbyist may desire to store the kiln in a closet or move the kiln through a doorway to another room for storage, but conventional kilns are not designed for such movement on a regular basis. Hence, there is a need for a kiln design that allows the kiln to be easily moved and stored when not in use.

BRIEF SUMMARY OF THE INVENTION

The problems and needs outlined above are addressed by the present invention. In accordance with one aspect of the present invention, a kiln is provided, which includes an oven portion and a metal outer shell. The oven portion has an insulating sidewall defining an oven space. The metal outer shell has a shell sidewall radially spaced from the oven portion sidewall. An air channel is formed in the annulus between the outer shell sidewall and the oven portion sidewall. The outer shell has a generally C-shaped cross-section. The outer shell has upper and lower vent openings formed therein so that air may flow through the vent openings into and out of the air channel.

The kiln of the present invention may also include a control box attached to the outer shell in such a way that the control box does not have direct thermal contact with the oven portion at points of attachment for the control box. This kiln may further include a platform base attached to the outer shell below the oven portion in such a way that the platform base does not have direct thermal contact with the oven portion at points of attachment for the platform base. The platform base may have riser portions at its attachment points so that there is an air gap between the platform base and a bottom of the oven portion. The riser portions may be integral with the platform base and formed on the platform base by bending corner portions of the platform base.

The platform base is dimensioned so that there is clearance spacing distance between a bottom of the oven portion and a floor when the kiln is sitting upright in an operational position on the floor to allow air circulation beneath the oven portion and into the lower vent openings. The metal outer shell may have tab portions that press against the oven portion, wherein a distal end of each of the tab portions is generally parallel with the outer shell sidewall and the distal ends of the tab portions are separated from the outer shell sidewall by a spaced distance, and wherein the tab portions are integral parts of the outer shell.

The outer shell is formed from a single sheet of metal by forming holes in the sheet for the vent openings and by bending end portions of the sheet to create the generally C-shaped cross-section, wherein the sheet is rolled into a generally cylindrical shape to fit about the oven portion. The kiln also includes strap clamps threaded through strap holes formed in the outer shell and wrapped about an outer portion of the oven portion so that the strap clamps attach the outer shell about the oven portion. The kiln further includes a set of wheels, a handle and a platform base.

In accordance with another aspect of the present invention, a portable kiln is provided, which includes a set of wheels, a handle, and a platform base. The set of wheels is attached on a first side of the kiln and at a lower portion of the kiln so that the kiln contacts a floor via the wheels when the kiln is in a tilted position and so that the kiln may be rolled on the wheels in the tilted position. The handle is attached on the first side of the kiln and extending from an upper portion of the kiln. The platform base extends from a bottom side of the kiln. The platform base has a height so that there is clearance between the wheels and the floor when the kiln is sitting upright in an operational position on the floor.

The portable kiln of the present invention may also include a control box attached to the outer shell, wherein the wheels and the handle are attached to the control box. The platform base may have a height dimension so that there is a spaced distance between a bottom of the oven portion and the floor when the kiln is sitting upright in the operational position on the floor to allow air circulation beneath the oven portion and into the lower vent openings. The handle preferably has a telescopic configuration allowing the handle to be extended and retracted.

In accordance with yet another aspect of the present invention, a kiln is provided that includes an oven portion, a lid, and a hinge assembly. The oven portion has a sidewall defining an oven space therein. The lid is adapted to at least partially cover the oven space. The hinge assembly has a first portion and a second portion. The lid is pivotably coupled to the oven portion by the hinge assembly. The hinge assembly is configured so that when the lid is in a fully open position, the second hinge portion presses against the first hinge portion to limit a pivotal movement range of the lid so that the lid can rest in the fully open position with the lid extending upwards and tilted away from the kiln.

In accordance with another aspect of the present invention, a portable kiln is provided, which includes the combination of an oven portion, a metal outer shell, a control box, a set of wheels, a handle, a platform base, a lid, and a hinge assembly. The oven portion has an insulating sidewall defining an oven space. The metal outer shell has a shell sidewall radially spaced from the oven portion sidewall forming an air channel. The control box is attached to the outer shell. The set of wheels is attached to the control box at a lower portion of the kiln. The handle is attached to the control box and extends from an upper portion of the kiln.

The platform base is attached to the outer shell below the oven portion. The lid is adapted to at least partially cover the oven space. The hinge assembly has a first portion and a second portion. The first hinge portion is attached to the outer shell. The second hinge portion is attached to the lid. The lid is pivotably coupled to the outer shell by the hinge assembly. When the lid is in a fully open position, the second hinge portion presses against the first hinge portion to limit a pivotal movement range of the lid so that the lid can rest in the fully open position with the lid extending upwards and tilted away from the kiln.

BRIEF DESCRIPTION OF THE DRAWINGS

The above features of the present invention will be more clearly understood from consideration of the following descriptions in connection with accompanying drawings in which.

DETAILED DESCRIPTION OF THE PREFERRED EMBODIMENTS

Figure 1:
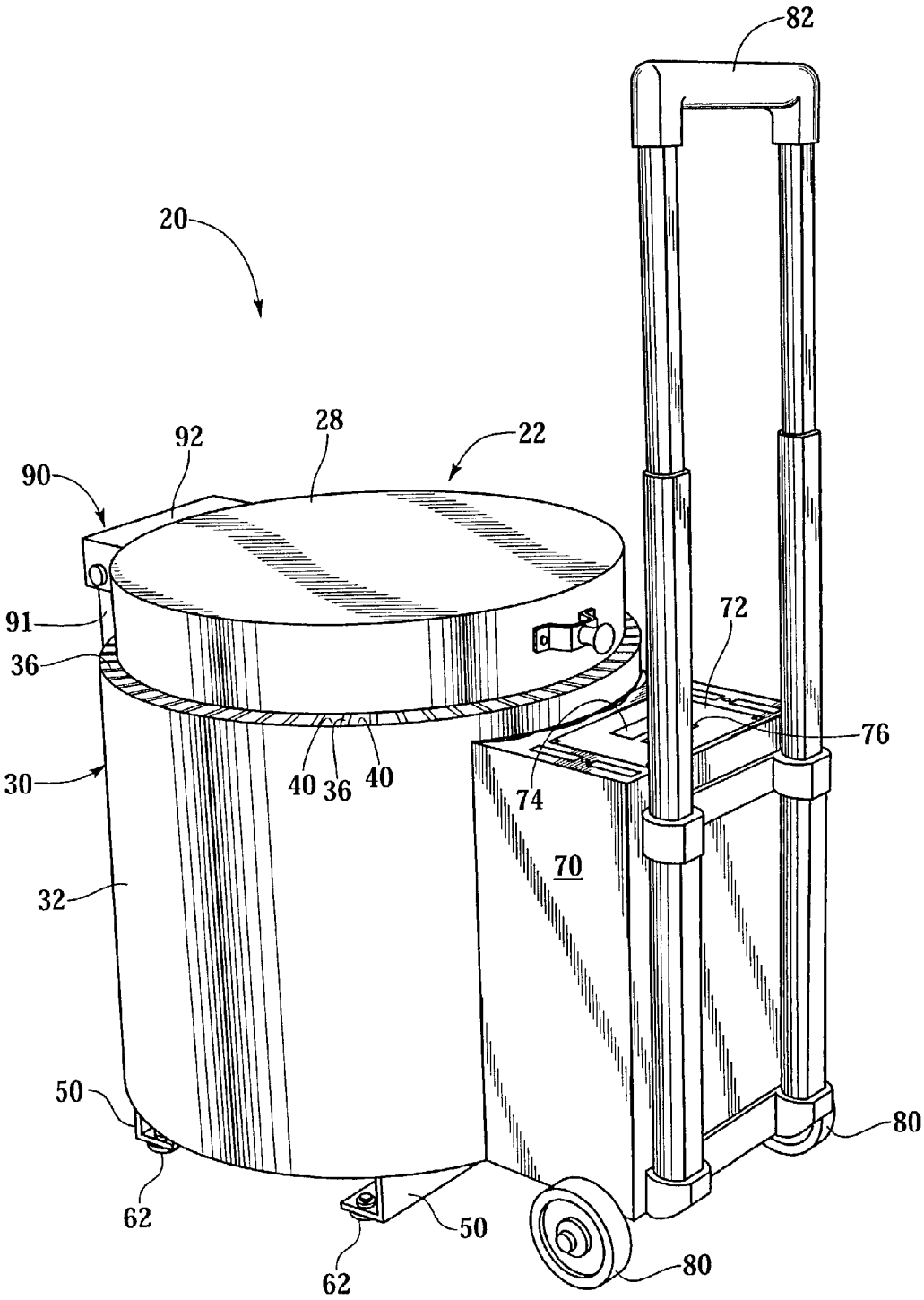
FIG. 1 is a front perspective view of a portable kiln in accordance with the preferred embodiment of the present invention.

Referring now to the drawings, wherein like reference numbers are used herein to designate like elements throughout the various views, a preferred embodiment of the present invention is illustrated and described. As will be understood by one of ordinary skill in the art, the figures are not necessarily drawn to scale, and in some instances the drawings have been exaggerated and/or simplified in places for illustrative purposes only. One of ordinary skill in the art will appreciate the many applications and variations of the present invention in light of the following description of a preferred embodiment of the present invention. The preferred embodiment discussed herein is an illustrative example of the present invention and does not limit the scope of the invention to the preferred embodiment shown.

Figure 3:
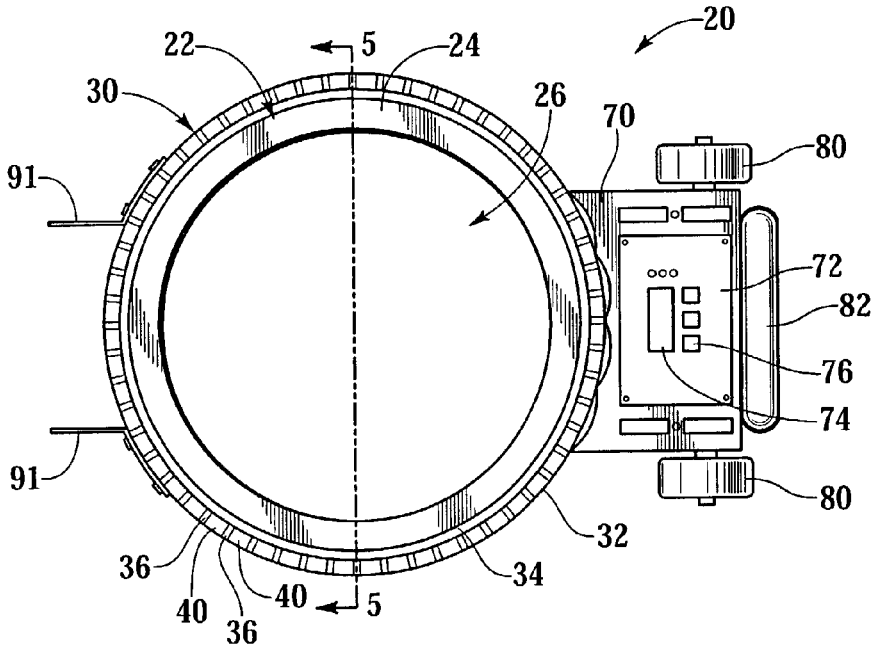
FIG. 3 is a top view of the portable kiln of FIGS. 1 and 2 with the lid removed.
Figure 2:
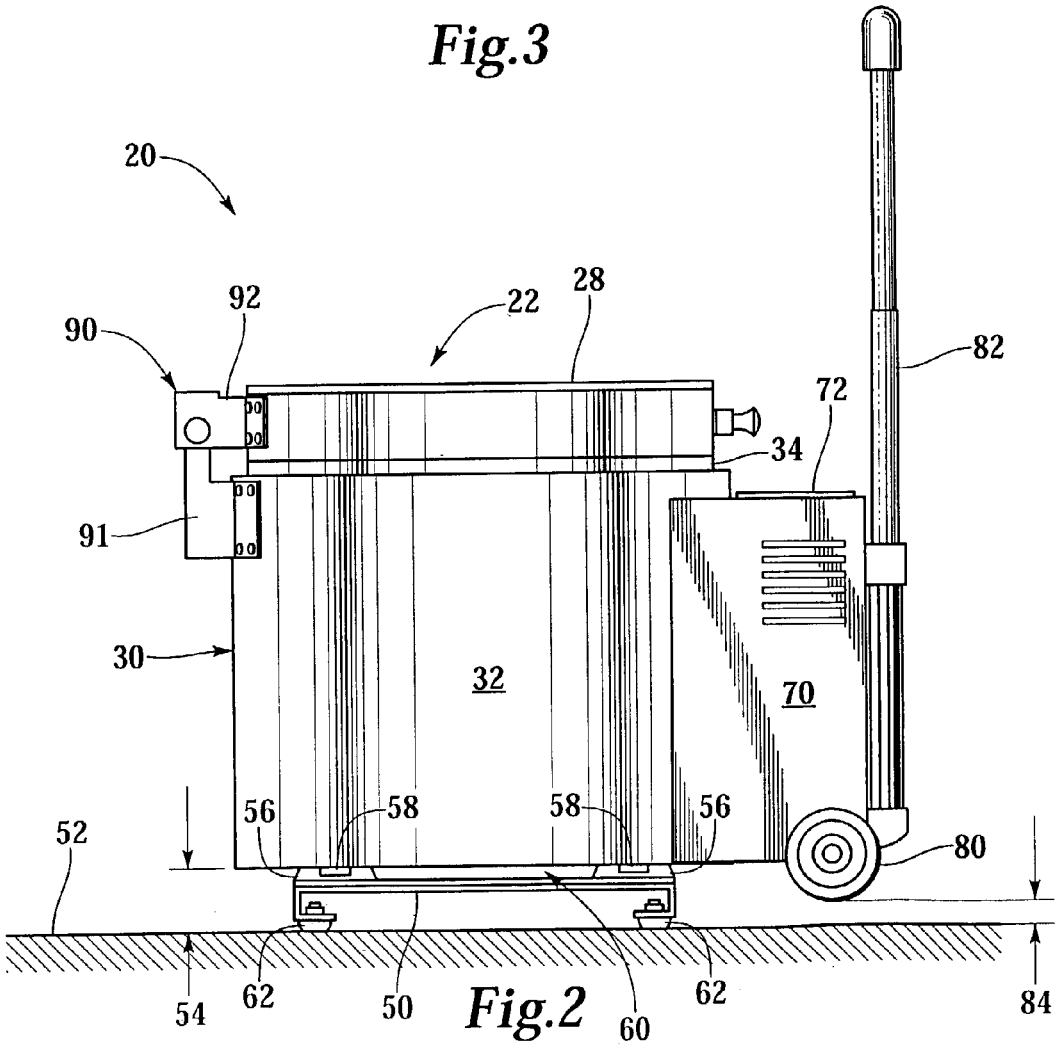
FIG. 2 is a side view of the portable kiln of FIG. 1.
Figure 4:
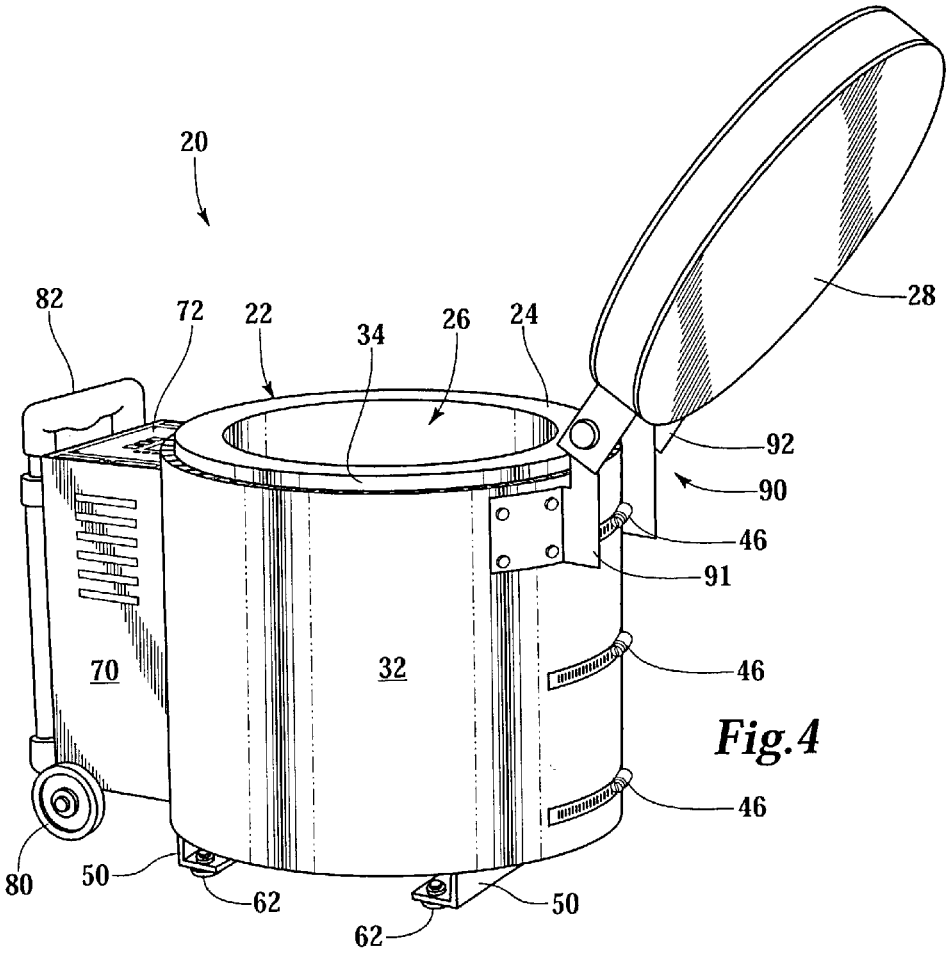
FIG. 4 is a rear perspective view of the portable kiln of FIG. 1 with the lid in an open position and the handle in a retracted position.

FIG. 1 is a front perspective view of the portable kiln 20, and FIG. 2 is a side view of the portable kiln 20. The kiln 20 has an oven portion 22 having an insulating sidewall 24 defining an oven space 26 therein. An insulating lid 28 is used to cover and enclose the oven space 26. In FIG. 3, a top view of the kiln 20 is shown without the lid 28 being attached to illustrate the insulting sidewall 24 and the oven space 26 of the oven portion 22. FIG. 4 is a rear perspective view of the kiln 20 with the lid 28 in a fully opened position, which also reveals the insulating sidewall 24 and the oven space 26.

The insulating oven sidewall 24 in this embodiment are one and a half inch thick ceramic fiber walls. A conventional kiln (not shown) of the same oven space size and operating at the same temperature ranges would normally have insulating walls made from three inch thick fired clay ceramic bricks, which is at least twice as heavy as the one and a half inch thick ceramic fiber walls 24 used in this embodiment. The first embodiment of the present invention can use thinner ceramic insulation walls 24 than a conventional kiln because it incorporates a metal outer shell 30.

Figure 5:
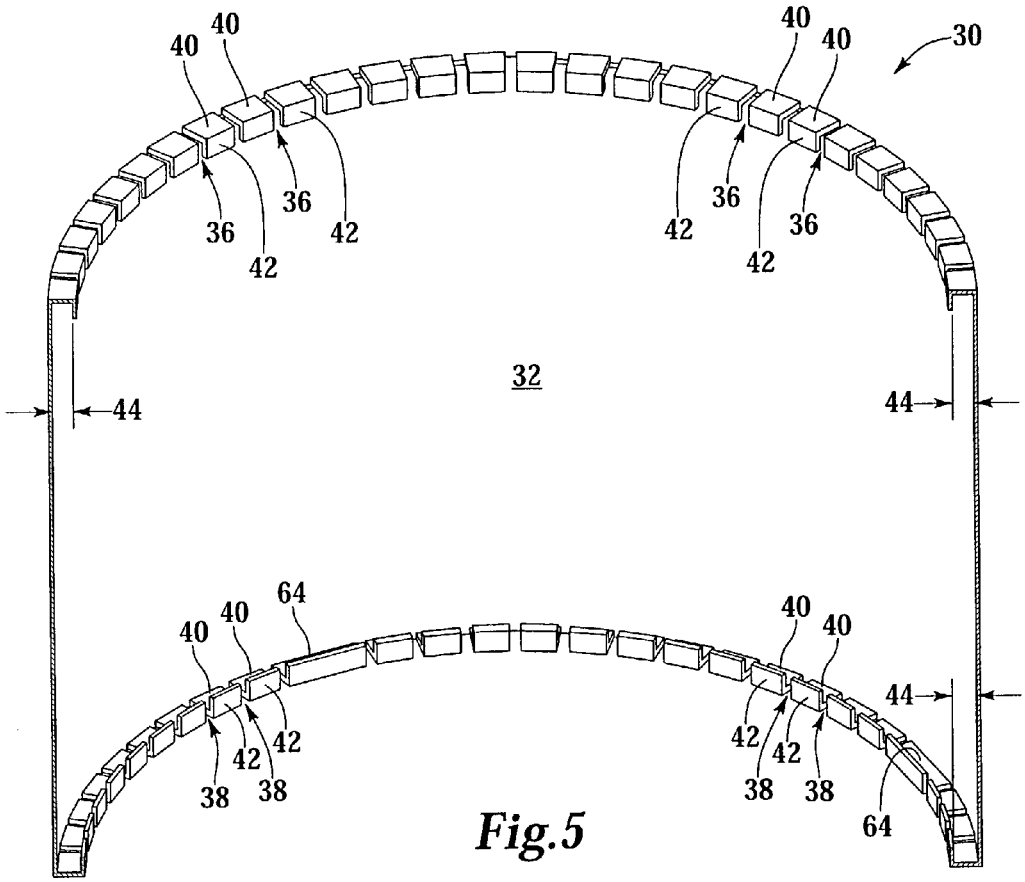
FIG. 5 is a sectional view of the metal outer shell as taken along line 5—5 in FIG. 3.

The metal outer shell 30 has a cylindrical shell sidewall 32 that is radially spaced from an oven portion sidewall 34 by about ⅝ inch to form a ⅝ inch annular air channel between the outer shell 30 and the oven portion 22. FIG. 5 is a sectional view of just the outer shell 30 as taken along line 5—5 in FIG. 3. As shown in FIG. 5, the outer shell 30 has a generally C-shaped cross-section. The outer shell 30 has upper and lower vent openings 36, 38 formed therein to allow air flow through the vent openings 36, 38 into and out of an annular air channel formed between the outer shell sidewall 32 and the oven portion sidewall 34.

The outer shell 30 may be formed from a single sheet of metal. Beginning with a flat 0.018 inch thick sheet of stainless steel, for example, rectangular holes may be formed in the sheet for the vent openings 36, 38. Upper and lower end portions of the sheet where the vent holes are formed may then be cut, with the cuts crossing through the vent holes to form tab portions 40. However, the ends may be cut before cutting the rectangular holes for the vent openings. The end portions of the sheet may then be bent to form the generally C-shaped cross-section shape. Then, the sheet may be rolled into a generally cylindrical shape to fit about the oven portion 22. These manufacturing steps provide the resulting outer shell structure 30, as shown in part in FIG. 5. Distal ends 42 of the tab portions 40 may be generally parallel with the outer shell sidewall 32 and separated from the outer shell sidewall 32 by a spaced distance 44 (e.g., about ⅝ inch in this embodiment).

Figure 6:
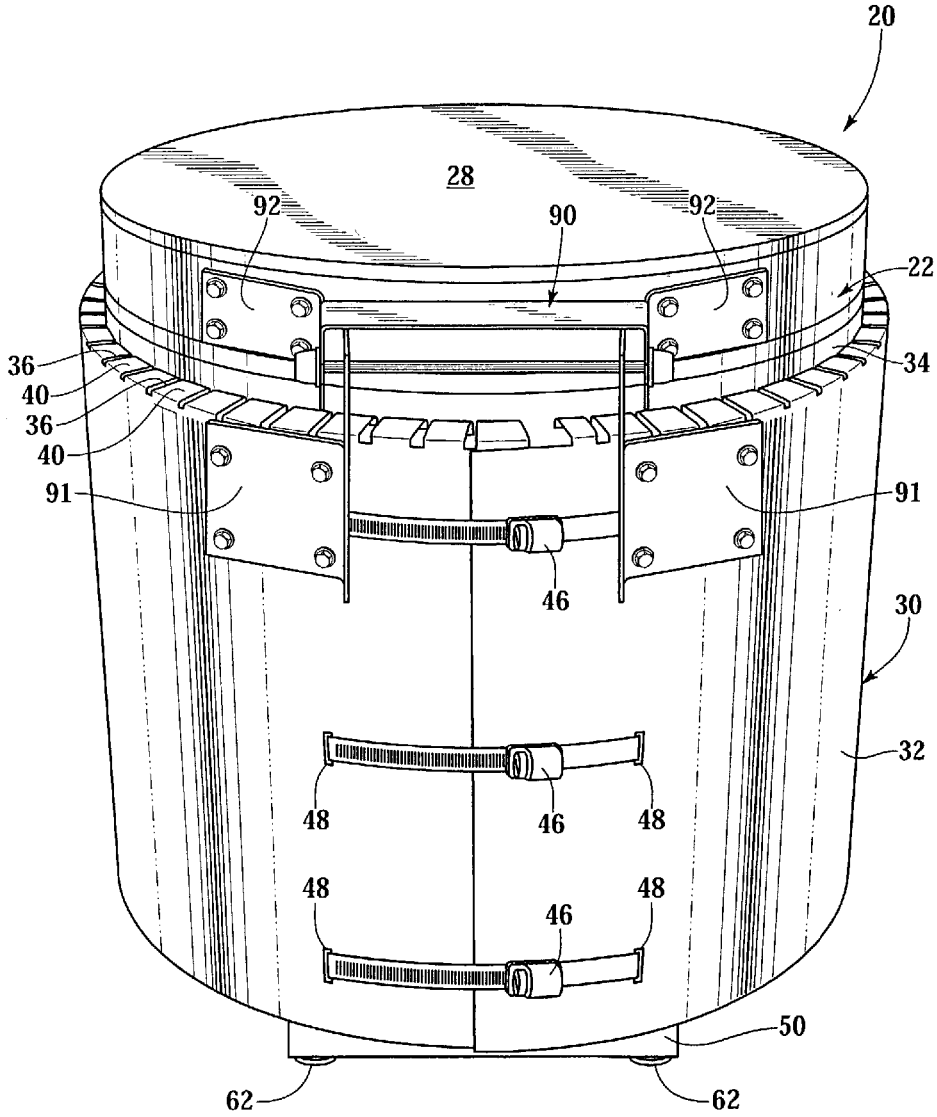
FIG. 6 is a rear view of the portable kiln of FIG. 1.

FIG. 6 shows a rear top perspective view of the portable kiln 20. As shown in FIG. 6, the outer shell 30 may be held onto the oven portion 22 using strap clamps 46, which resemble very long hose clamps. Each strap clamp 46 is threaded through strap holes 48 formed in the outer shell 30 and is wrapped about the oven sidewall 34 of the oven portion 22 within the annular air channel (not shown). When the outer shell 30 is installed on the oven portion 22, most or all of the distal ends 42 of the tab portions 40 press against the oven sidewall 34 of the oven portion 22. In another embodiment (not shown), sheet metal screws may be used in addition to or in alternative to the strap clamps 46 to hold the outer shell 30 in place about the oven portion 22.

FIGS. 1, 2, 4, and 6 show the kiln 20 in an upright and operation position. A platform base 50 extends from the bottom of the kiln 20 and supports the kiln 20 to elevate the oven portion 22 above a floor surface when the kiln 20 is upright and operational. As shown in FIG. 2, the outer shell 30 is separated from a floor surface 52 by a spaced distance 54 due to the platform base 50. This allows the lower vent openings 38 to remain unobstructed and allows cool air to pass through the lower air vents 38 into the air channel and out of the air channel through the upper vent openings 36 for convection cooling. Hence, the convection air flow through the air channel provides insulation for the outer shell sidewall 32 and cools the outer shell sidewall 32.

The surface temperature rise of the outer shell sidewall 32 should not exceed 200° F. under maximum heat when the temperature in the oven space 26 is about 2000° F. and the temperature on the outer surface of the oven portion sidewall 34 (inside the air channel) is about 600° F. Thus, this design provides a reduced outer surface temperature that is at least as low as it would be under the same conditions for a convention kiln having three inch fired clay ceramic brick walls. The total weight of the preferred embodiment is about thirty-seven pounds. The substantial weight reduction is achieved by the reduction in ceramic fiber needed (about 50% less ceramic fiber needed) in the ceramic fiber walls 24 for this design compared to a convention kiln design (i.e., design without an outer shell defining an annular air channel) makes the kiln 20 easier to move for the average person.

Figure 7:
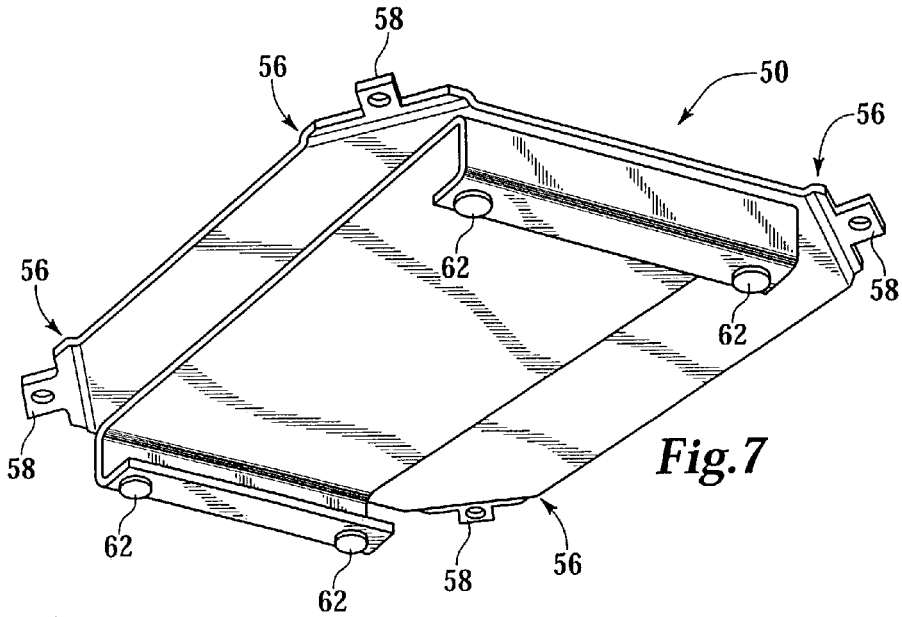
FIG. 7 is a perspective view of the platform base of the portable kiln of FIG. 1.

FIG. 7 is a bottom perspective view of the platform base 50 (shown separated from the remainder of the kiln 20). The platform base 50 preferably attaches directly to tab portions 40 on the outer shell 30 and does not directly contact the oven portion 22 (i.e., no direct thermal contact with the oven portion 22).

The platform base 50 shown in FIG. 7 has riser portions 56 at the attachment points 58 so that when the platform base 50 is installed on the kiln 20, there is an air gap 60 between the platform base 50 and the bottom of the oven portion 22 (see e.g., FIG. 2). This air gap 60 acts as an insulator between the oven portion 22 and the platform base 50, and the air gap 60 allows air to flow between the oven portion 22 and the platform base 50. The riser portions 56 in the first embodiment are integral with the platform base 50 as bends in the platform base 50.

In other embodiments (not shown), the riser portions may be separate pieces, such as washers at the attachment points 58, to provide the air gap 60 between the oven portion 22 and the platform base 50. Accordingly, having the riser portions 56 and the platform base 50 attached to the outer shell helps to keep the platform base temperatures much cooler than if the platform base 50 were simply attached to the bottom of the oven portion without the air gap 60. However, in other embodiments (not shown), there may be no riser portions (i.e., flat sheet for the top portion of the platform 50 rather than being bent at riser portions 56) and no air gap 60.

The platform base 50 has rubber pads 62 attached on its bottom side (see FIGS. 2 and 7). The kiln 20 sits on the rubber pads 62 when upright in an operation position (see, e.g., FIG. 2). The rubber pads 62 help keep the kiln 20 from sliding on a floor surface 52 and prevents damage to the floor surface 52. The rubber pads 62 also act as thermal insulators between the platform base 50 and the floor surface 52. Due to the insulating features of the platform base (i.e., being attached to the outer shell 30 and having riser portions 56) and the rubber pads 62, the first embodiment may be used on most household floors without causing damage.

Another advantage of the platform base 50 is that the bottom of the oven portion 22 is separated from a floor surface 52 by a spaced distance 54, which allows air to flow beneath the oven portion 22 and beneath portions of the platform base 50 (see e.g., FIG. 2). This helps to cool the platform base 50 during operation of the kiln 20.

As shown in FIG. 5, some of the tab portions 40 may be made wider (see wider tab 64 in FIG. 5) to provide sufficient attachment space for the platform base 50. Hence, the platform base 50 preferably attaches to the wider tabs 64.

A control box 70 is attached to the outer shell 30. The control box 70 preferably does not have direct thermal contact with the oven 22 at its points of attachment. This is possible when the control box 70 is attached to the outer shell 30, as in the first embodiment. As shown in FIG. 3, a control panel 72 is mounted on the control box 70. The control panel 72 has a digital display 74 and buttons 76 for interfacing with the electronic furnace controller components (not shown) within the control box 70, such as a circuit board, a transformer, and relays, for example. Preferably the control panel 72 is digital, but analog gauges or manual switches (not shown) may be used as well in other embodiments.

A set of wheels 80 are attached to the control box 70. Also a handle 82 is attached to the control box 70 proximate to the wheels 80. The handle 82 preferably has a telescopic configuration so that it may be expanded or retracted. For example, in FIGS. 1 and 2, the handle 82 is shown in an expanded position, which is preferred while moving the kiln 20 to provide greater leverage when tilting the kiln 20 onto the wheels 80. In FIG. 4, the handle 82 is shown in a retracted position, which is preferred during storage of the kiln 20 to reduce the storage space needed to house the kiln 20. Also, the retracted position for the handle 82 may be preferred when the kiln 20 is being used so that the handle 82 is not obtrusive to the control panel 72 and the oven space 26. The wheels 80 are arranged so that when the kiln 20 is in a tilted position, the wheels 80 contact a floor surface 52, the kiln 20 is supported by the wheels 80, and the kiln 20 may be rolled on the wheels 80 in the tilted position. But when in the upright and operational position, as shown in FIG. 2, the platform base 50 has a height so that there is a spaced distance 84 between the wheels 80 and the floor surface 52.

In the preferred embodiment, the platform base 50 is configured so that the kiln 20 can be tilted by pulling back on the handle 82 (preferably when the handle 82 is extended) and pivoted on the rubber pads 62 adjacent to the wheels 80. The wheels 80 are positioned so that as the kiln 20 is tilted back, the kiln 20 begins to rest on the wheels 80. Further tilting puts more of the kiln's weight on the wheels 80 and the rubber pads 62 ceases to contact the floor 52. With the kiln 20 resting on the wheels 80 and being balanced with the handle 82 in a tilted position, the kiln 20 may be easily rolled across the floor 52 and repositioned. When fully cooled to room temperature, the kiln 20 may be wheeled into a closet for storage, for example. Hence, an advantage of the preferred embodiment is that the kiln 20 can be moved easily by an average person and stored away when not in use.

Figure 8:
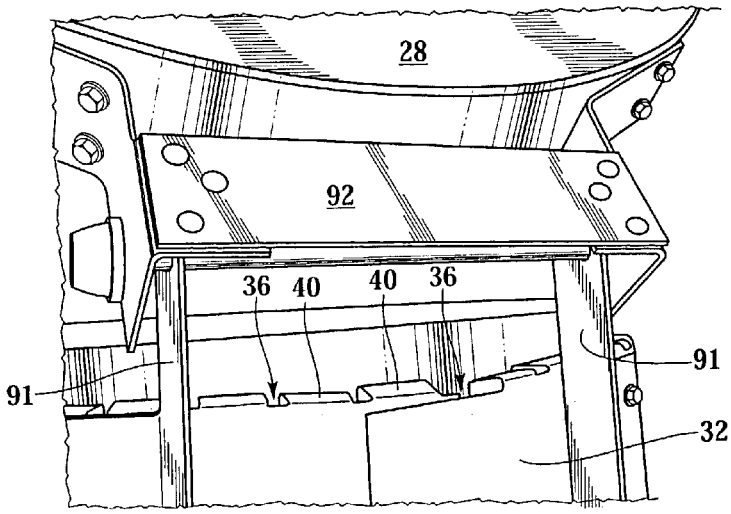
FIG. 8 is an enlarged view of the portable kiln with the lid half opened to focus on the hinge assembly.

Referring now to FIGS. 4 and 8, the lid 28 is attached to the outer shell 30 by a hinge assembly 90. A first portion 91 of the hinge assembly 90 is attached to the outer shell 32. A second portion 92 of the hinge assembly 90 is attached to the lid. An enlarged view of the hinge assembly 90 is shown in FIG. 8, with the lid half open, to illustrate the first and second hinge portions 91, 92. The hinge assembly 90 is designed to allow the lid 28 to rest in a fully opened position, as shown in FIG. 4, without the use of a spring, a restraining chain, or a restraining linkage in tension. When in the fully opened position, the second hinge portion 92 presses against the first hinge portion 91 to limit a pivotal movement range of the lid 28. Thus, the lid 28 can rest in the fully open position with the lid 28 extending upwards and tilted away from the kiln 20, as shown in FIG. 4.

In other embodiments (not shown), the first hinge portion 91 may be attached to the oven portion 22 (i.e., oven sidewall 34) rather than the outer shell 30. Also, a spring (not shown) may be added to assist in lifting the lid 28 from the closed position. Also in other embodiments (not shown), the lid 28 may open sideways or towards the control box 70, rather than opening away from the control box as in FIG. 4.

Although the invention has been described with reference to certain exemplary arrangements, it is to be understood that the form of the invention shown and described is to be treated as a preferred embodiment. In light of the description herein, various changes, substitutions, and modifications may be realized without departing from the spirit and scope of the invention defined by the following claims.

We claim:

1. A kiln, comprising:

an oven portion having an insulating sidewall defining an oven space;

a metal outer shell having a shell sidewall radially spaced from the oven portion sidewall, wherein an air channel is formed between the outer shell sidewall and the oven portion sidewall and the outer shell having upper and lower vent openings formed therein so that air may flow through the vent openings into and out of the air channel;

a control box attached to the outer shell so that the control box does not have direct thermal contact with the oven portion at points of attachment;

a set of wheels attached to the control box at a lower portion of the kiln;

a handle attached the control box and extending from an upper portion of the kiln; and a platform base disposed beneath the oven portion, the platform base having a height providing a spaced distance between the wheels and a floor when the kiln is sitting upright in an operational position on the floor.

2. A portable kiln, comprising:

a set of wheels attached on a first side of the kiln and at a lower portion of the kiln so that the kiln contacts a floor via the wheels when the kiln is in a tilted position and so that the kiln may be rolled on the wheels in the tilted position;

a handle attached on the first side of the kiln and extending from an upper portion of the kiln;

a platform base extending from a bottom side of the kiln, the platform base having a height so that there is a spaced distance between the wheels and the floor when the kiln is sitting upright in an operational position on the floor;

an oven portion having an insulating sidewall defining an oven space;

a metal outer shell having a shell sidewall radially spaced from the oven portion sidewall, wherein an air channel is formed between the outer shell sidewall and the oven portion sidewall, and the outer shell having upper and lower vent openings formed therein so that air may flow through the vent openings into and out of the air channel; and a control box attached to the outer shell so that the control box does not have direct thermal contact with the oven portion at points of attachment, and the wheels and the handle are attached to the control box.

3. A portable kiln, comprising:

an oven portion having an insulating sidewall defining an oven space;

a metal outer shell having a shell sidewall radially spaced from the oven portion sidewall, wherein an air channel is formed between the outer shell sidewall and the oven portion sidewall, and the outer shell having upper and lower vent openings formed therein so that air may flow though the vent openings into and out of the air channel;

a control box attached to the outer shell;

a set of wheels attached to the control box at a lower portion of the kiln;

a handle attached the control box and extending from an upper portion of the kiln;

a platform base attached to the outer shell below the oven portion;

a lid adapted to at least partially cover the oven space; and a hinge assembly having a first portion and a second portion, the first hinge portion being attached to the outer shell, the second hinge portion being attached to the lid, the lid being pivotally coupled to the outer shell by the hinge assembly, and when the lid is in a fully open position, the second hinge portion presses against the first hinge portion to limit a pivotal movement range of the lid so that the lid can rest in the fully open position with the lid extending upwards and tilted away from the kiln.

4. The portable kiln of claim 3, wherein the platform base has riser portions at the platform attachment points thereby providing an air gap between the platform base and a bottom of the oven portion.

5. The portable kiln of claim 3, wherein the platform base has a height dimension so that there is a spaced distance between the wheels and a floor when the kiln is sifting upright in an operational position on the floor.

6. The portable kiln of claim 3, wherein the platform base has a height dimension so tat there is a spaced distance between a bottom of the oven portion and a floor when the kiln is sitting upright in an operational position on the floor to allow air circulation beneath the oven portion and into the lower vent openings.

7. The portable kiln of claim 3, the outer shell having a generally C-shaped cross-section with tab portions disposed in engagement against the oven portion, wherein a distal end of each of the tab portions is generally parallel with the outer shell sidewall and the distal ends of the tab portions are separated from the outer shell sidewall by a spaced distance, and wherein the tab portions are integral parts of the outer shell.

* * * * *